United States Patent [19]

DiFranco

[11] Patent Number: 4,815,738

[45] Date of Patent: Mar. 28, 1989

[54] TENNIS BALL RETRIEVER

[76] Inventor: Jack E. DiFranco, 1077 River Rd., Edgewater, N.J. 07020

[21] Appl. No.: 46,164

[22] Filed: May 7, 1987

[51] Int. Cl.[4] ..... A63B 49/00; A47F 13/06

[52] U.S. Cl. ..... 273/73 J; 273/75; 294/19.2

[58] Field of Search ..... 273/73 R, 32 F, 73 J, 273/73; 294/19.2

[56] References Cited

U.S. PATENT DOCUMENTS

| | | | |
|---|---|---|---|
| 266,598 | 10/1882 | Alexander | 273/73 R |
| 491,558 | 2/1893 | Hill | 294/19.2 |
| 1,540,823 | 2/1925 | Mairhofen | 273/73 R |
| 2,801,875 | 8/1957 | McEvoy | 273/73 R |
| 2,819,109 | 1/1958 | Borah | 294/19.2 |
| 3,462,184 | 8/1969 | Russell | 273/73 R |
| 4,114,881 | 9/1978 | Norton | 273/73 R |
| 4,210,327 | 7/1980 | Schubert | 273/73 R |

FOREIGN PATENT DOCUMENTS

| | | | |
|---|---|---|---|
| 2539633 | 7/1984 | France | 273/73 R |
| 2554724 | 5/1985 | France | 273/73 R |
| 480051 | 4/1953 | Italy | 273/73 R |
| 501523 | 11/1954 | Italy | 273/73 R |
| 509811 | 8/1955 | Italy | 273/73 R |

*Primary Examiner*—Richard C. Pinkham
*Assistant Examiner*—Gary Jackson
*Attorney, Agent, or Firm*—Alvin S. Blum

[57] ABSTRACT

A tennis ball retriever at the handle end of a tennis racket has flexible petals arranged around a ball-receiving recess. Nap-catching pins attached to the petals project into the recess. When the retriever is forced over a tennis ball, the petals open outwardly, permitting the ball to enter the recess. The pins are forced elastically into the nap covering the ball, thereby holding the ball in place so that it may be lifted from the ground without stooping.

13 Claims, 3 Drawing Sheets

TENNIS BALL RETRIEVER

BACKGROUND OF THE INVENTION

This invention relates to devices for picking up balls without stooping over and more particularly to a device at the handle of a tennis racket that easily picks up and releases a tennis ball.

German Offenlegungsschrift No. 2,254,275 teaches a recess at the handle end of a tennis racket having a contour corresponding to the ball. The recess is lined with an adhesive for sticking to the ball. However, the adhesive will become coated with clay, dirt, water and the like and thereby lose its ability to pick up the ball. Furthermore, the adhesive may transfer to the ball under certain conditions. U.S. Pat. No. 3,874,666 describes a plurality of hooks as exemplified by the hooked portion of a hook-and-pile mating means trademarked VELCRO that is rigidly mounted on the rim or directly on the strings of the racket. A ball engaging surface of this material great enough to lift the ball may disturb the balance of the racket. Many patents describe spring fingers that reach at least to the diameter of a ball or beyond to engage a ball as exemplified by U.S. Pat. Nos. 266,598; 802,264; 3,698,720; 4,334,707; 4,398,716 and U.K. No. 2,128,484. In order to reach at least to the diameter of a ball as large as a tennis ball, the fingers must be of a length, or mounted apart so widely as to disturb the normal operation of the racket.

SUMMARY OF THE INVENTION

It is, accordingly, an object of the invention to provide a ball retrieving device for the handle end of a tennis racket that will effectively engage the ball when the handle end is pressed onto the ball, and that will release the ball manually without effort or damage to the ball.

It is an object to provide a ball pick-up device that will not deteriorate with use, and with contamination from the environment.

It is yet another object of the invention to provide said ball pick-up device that will be of such small dimensions and weight as to not adversely affect the use of the racket.

It is yet another object to provide, in one embodiment of the invention, said ball pick-up device that may be readily attached to the handle.

It is yet another object to provide, in another embodiment, a ball pick-up device that forms a part of the grip of the handle.

It is yet another object to provide, in another embodiment, a tennis racket incorporating said ball pick-up device.

The device of the invention includes a handle-attaching base and a plurality of petals flexibly joined at said base. The petals bear nap-catching pins. Each petal is joined at a first end to the base and is movable at a second, opposite end. The petals are arranged about the perimeter of the base with said second ends directed away from said racket to form a substantially cup-shaped recess with readily distendable walls. The nap-catching pins are on the surface of each petal that is directed inwardly towards the center of the cup. The petals and their attachments have sufficient flexibility that they will open outwardly when the recess is centered over a tennis ball and forced down upon it. Because the recess has a diameter less than that of the ball, each petal will, by virtue of the aforementioned flexibility bend outwardly and its inner, pin-bearing surface will engage the nap of the ball, holding it firmly even though the greatest diameter of the open petals will not extend around the ball to its diameter. When not applied to a ball, the petals will elastically return to their relaxed, or closed, state with a minimal diameter that is small enough to not interfere with normal operation of the racket.

DETAILED DESCRIPTION OF THE PREFERRED EMBODIMENTS

Figure 1:
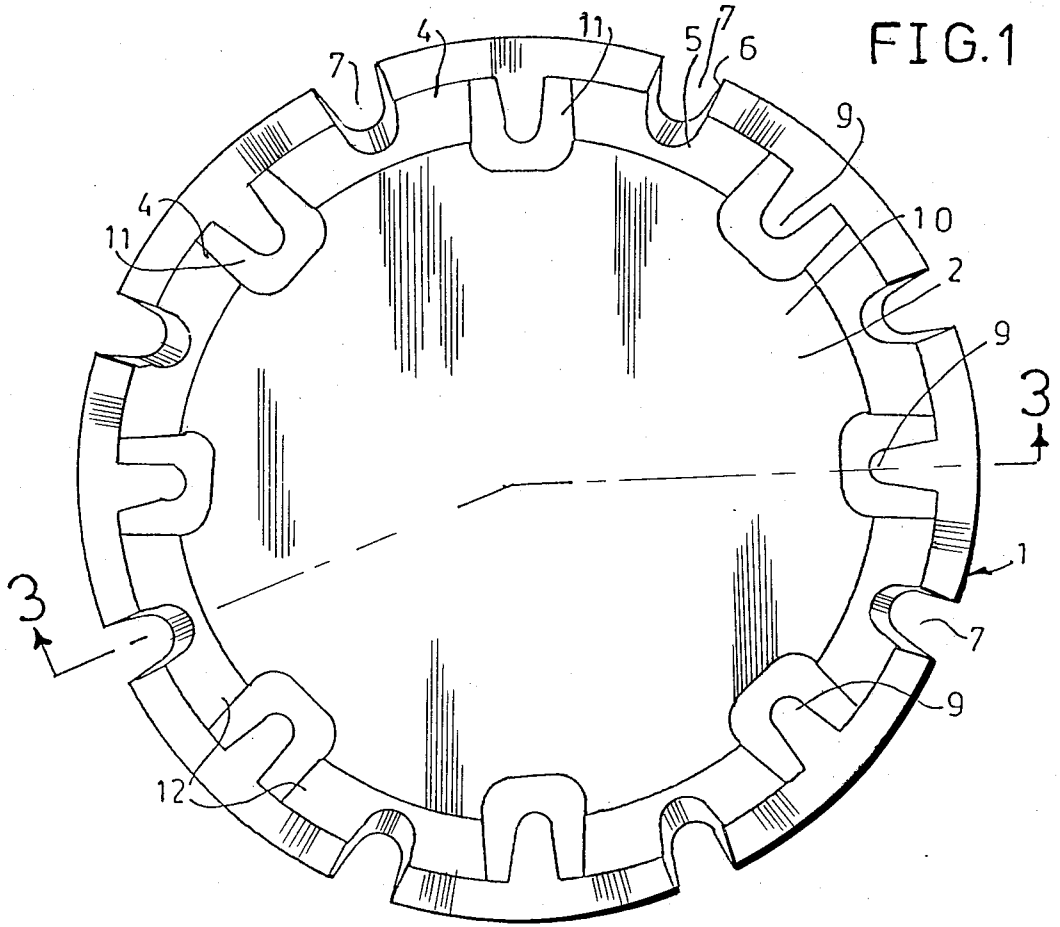
FIG. 1 is a top plan view of an embodiment of the invention.
Figure 2:
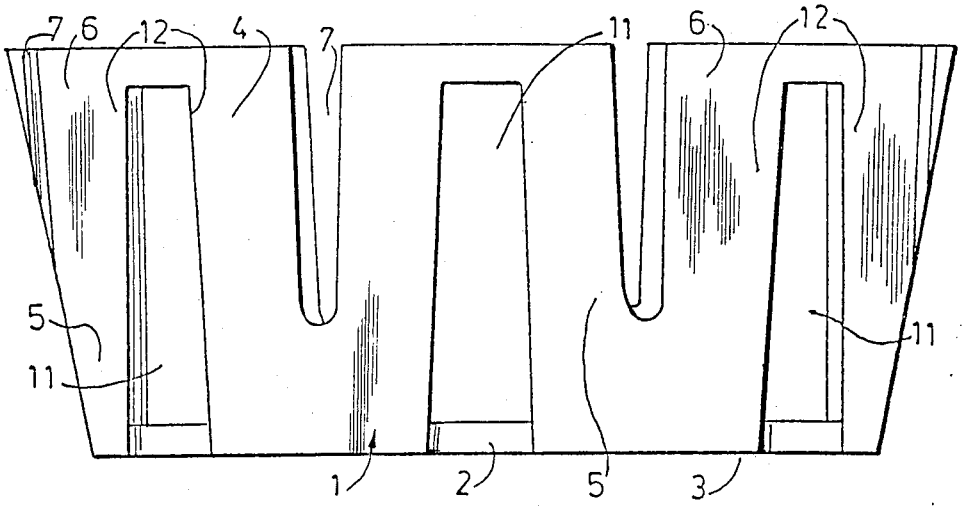
FIG. 2 is a front elevation view of the device of FIG. 1.
Figure 3:
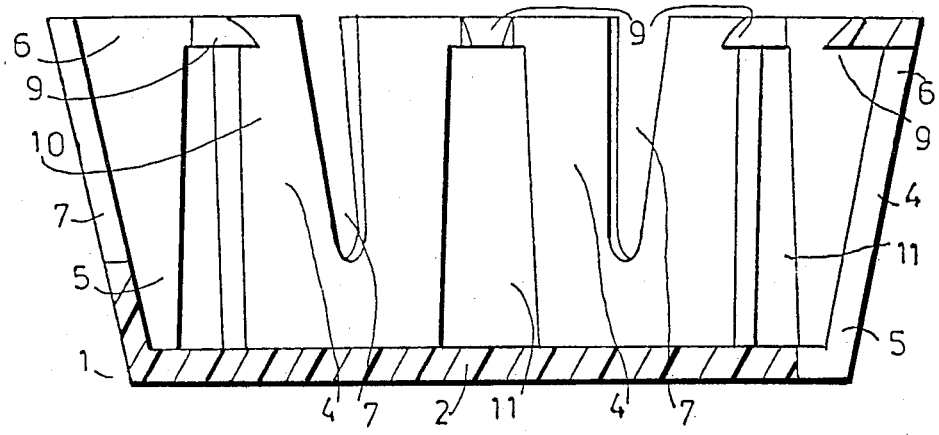
FIG. 3 is a front elevation sectional view taken along the plane of line 3—3 of FIG. 1, and looking in the direction of the arrows.

Referring now to the drawings in greater detail, FIGS. 1–3 illustrate a device 1 of the invention having a base 2 in the form of a disc. The lower surface 3 of the base 2 is attached to the end of the handle of a tennis racket by attaching means well known in the art including adhesives, screws and the like. Petals 4 are joined at a first end 5 to base 2. Petals 4 are freely movable at a second end 6. Molded slots 7 separate the movable second ends 6 of the petals when the device is molded in one piece as shown here. Nap-catching pins 9 are molded into the inwardly-facing surfaces of petals 4.

This device is firmly attached to the end of the handle of a tennis racket. To pick up a fallen tennis ball without stooping, the racket is grasped by the frame end, the device is positioned over the ball, and forced down onto the ball. As the ball moves into the recess 10 formed by the encircling petals, the petals 4 are forced outwardly by the ball at their second ends like the blooming of a flower. The device, or at least the petals, are formed of an elastic material to permit them to bend outwardly to an open position and to have sufficient elastic memory to enable them to return to a closed inward position when the ball is removed so that the device has a smaller outside diameter and thereby disturbs the dimensions and playing performance of the racket less.

The elastic memory also causes the petals to press against the ball, causing nap-engaging pins 9 to be forced against the surface of the ball. The pins are small enough to penetrate the nap of fibers covering the ball, thereby engaging the ball with sufficient tenacity to enable the user to lift up the ball with the racket. The flexibility of the petals enables the user to pull the ball free manually without damage to the device or the ball.

The apertures 11 in the petals 4 below the pins 9 provide a means for molding the pins and the entire device in one piece with a simple two-piece mold using a straight-light opening and closing of the mold. The aperture 11 in petal 4 also makes the petal more flexible by removing petal material, so that it has two narrow legs 12, separated by the aperture 11.

Figure 4:
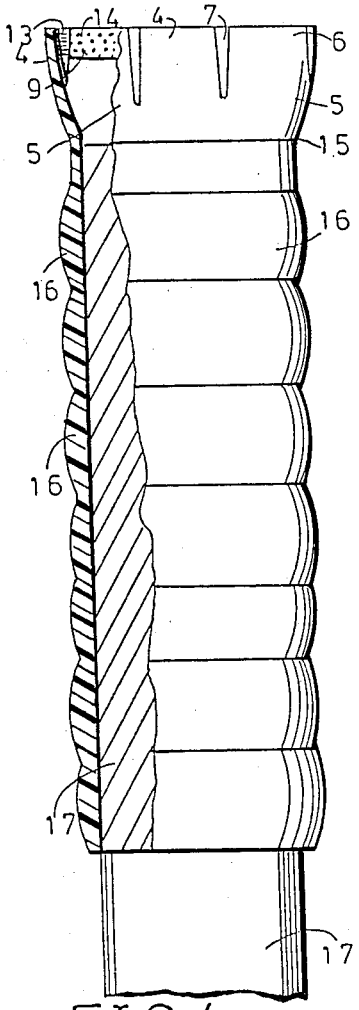
FIG. 4 is a fragmentary front elevation view of another embodiment of the invention on the handle of a tennis racket formed in combination with the handle grip.

Each petal is shown bearing a single pin 9. However, each petal may bear a plurality of pins. FIG. 4 illustrates an embodiment of the invention wherein each petal 4 bears a plurality of pins 9 shown in side view at 13 and end on at 14. These many fine pins may be molded into the petals. Alternatively, they may be molded into a support that is later affixed to the petal 4 at the free end 6. Alternatively, these pins may be the hook portion of the hook and loop fastener means trademarked VELCRO. The petals 4 of FIG. 4 are joined at their lower ends 5 to a circumferential base 15 that is a part of the tennis racket grip 16 that is attached to the tennis racket 17, shown here partially broken away. The retriever, grip and racket may be manufactured together. The retriever and grip may be manufactured together for fitting onto a racket.

Figure 5:
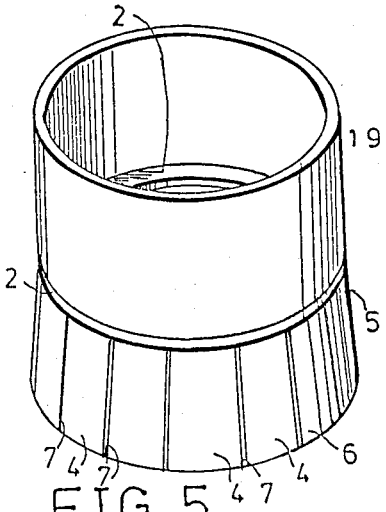
FIG. 5 is a perspective view of another embodiment of the invention for sliding over the end of a raquet.
Figure 6:
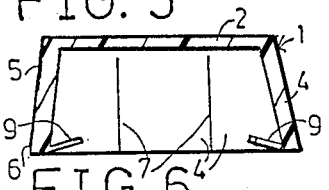
FIG. 6 is a front elevation sectional view of the device with angled pins.
Figure 7:
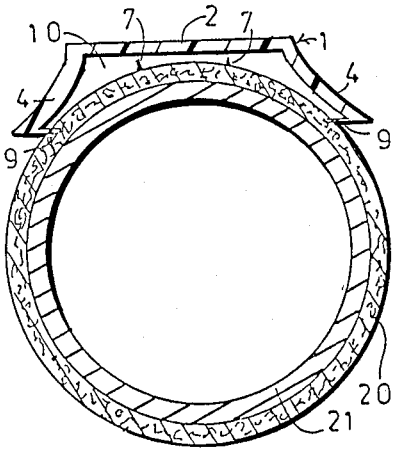
FIG. 7 shows diagrammatically the device of FIG. 6 interacting with a tennis ball.

Alternatively, the retriever such as shown in FIGS. 1–3 may be affixed to the end of a racket. The retriever of FIG. 5 includes a thin sleeve 19 with a ring-like base 2 supporting the petals, that are separated from each other by slots 7. The sleeve 19 is slipped over the handle end of the racket for securing the device to a racket. The retriever of FIGS. 6 and 7 has nap-catching pins 9 attached to petals 4 at such an angle that, when the petals are "opened" as in FIG. 7 by forcing onto a tennis ball, the pins will point inwardly to better grip the nap 20 of tennis ball 21.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A tennis ball retriever for removably grasping a tennis ball by forcing the handle end of a tennis racket upon said ball, comprising: a one-piece molded cup having substantially the shape of a frustum of a cone with a substantially flat base at a smaller first end, a substantially conical slotted wall extending from the perimeter of said base to an open, larger, second end, said slotted wall including a plurality of first slots and second slots;

said first slots coextensive with said open, second end and extending axially from said second end toward said base, each adjacent pair of said first slots defining a portion of wall therebetween having the form of a petal attached at said base and movable at said open end so that said petals forming said wall can spread apart at said open end when said open end is forced upon said ball with sufficient elasticity to retract when said ball is removed, thereby providing said wall with an expansible diameter at said open end;

at least one nap-engaging tooth means coextensive with each said petal at said open end and extending radially and inwardly into said cup for holding said ball in place;

each of said second slots originating in said base and extending axially in said petal toward said open end and terminating at said nap-engaging tooth means, said second slots thereby providing means for molding said retriever in one piece with a die with simple rectilinear open and closing motion, said second slots further enhancing the flexibility of said petals.

2. The retriever according to claim 1, in which the diameter of said open end is less than the diameter of a standard tennis ball.

3. The retriever according to claim 1, in which said base includes handle attaching means for attaching said retriever to the butt end of the handle of said tennis racket.

4. The retriever according to claim 3, in which said handle attaching means includes adhesive means.

5. The retriever according to claim 3, in which said handle attaching means includes sleeve means for sliding over the butt end of said tennis racket.

6. The retriever according to claim 1, in which said tooth means includes the hook portion of hook-and-loop fastening means.

7. A tennis ball retriever for removably grasping a tennis ball by forcing the handle end of a tennis racket upon said ball, comprising: a one-piece molded cup with a substantially flat base at a first end for attaching to the butt end of said handle;

a substantially cylindrical wall extending from said first end to a second, open end for receiving a portion of said ball; a plurality of slots in said wall substantially parallel to each other, originating at said open end and extending toward said base, said slots thereby defining a plurality of petals joined at said base, arcuate in transverse section, and free to elastically open out at said open end when said open end is forced over said ball, thereby providing said wall with an expansible diameter at said open end;

at least one nap-engaging tooth means at the open end of each said petal, said tooth means connected at its base to said petal and extending radially toward the axis of said cup for releasably engaging the nap covering said ball.

8. The retriever according to claim 7, in which said base includes attaching means for attaching to said handle.

9. The retriever according to claim 8, in which said attaching means includes sleeve means.

10. The retriever according to claim 9, in which said sleeve means functions as the grip of said handle.

11. The retriever according to claim 7, in which said attaching means includes adhesive means.

12. The retriever according to claim 7 in which said tooth means includes the hook portion of hook-and-loop fastening means.

13. A tennis ball retriever for removably grasping a tennis ball by forcing the handle end of a tennis racket upon said ball, comprising: a one-piece molded cup with a substantially flat base at a first end for attaching to the butt end of said handle;

a substantially cylindrical wall extending from said first end to a second, open end for receiving a portion of said ball; a plurality of first slots in said wall substantially parallel to each other, originating at said open end and extending toward said base, said first slots thereby defining a plurality of petals joined at said base and free to elastically open out at said open end when said open end is forced over said ball, thereby providing said wall with an expansible diameter as said open end;

at least one nap-engaging tooth means at the open end of each said petal, said tooth means connected at its base to said petal and extending radially toward the axis of said cup for releasably engaging the nap covering said ball, in which said wall further includes at least one second slot in each petal, said second slot originating in said base, extending toward said open end and terminating at said tooth means for easier fabrication by a simple molding process.

* * * * *